US005833521A

United States Patent [19]

McPhee et al.

[11] Patent Number: 5,833,521

[45] Date of Patent: Nov. 10, 1998

[54] AIR CUSHIONED VACUUM BLAST HEAD

[75] Inventors: William S. McPhee, Arlington; Anh Nguyen, Herndon, both of Va.

[73] Assignee: LTC Americas, Inc., Sterling, Va.

[21] Appl. No.: 777,374

[22] Filed: Dec. 27, 1996

[51] Int. Cl.[6] ..... B24C 9/00

[52] U.S. Cl. ..... 451/87; 451/101; 451/102; 451/98

[58] Field of Search ..... 451/101, 87, 102, 451/99, 98, 75; 222/16, 17, 19; 239/336, 379, 9, 104, 119, 124, 654; 15/327.3, 302

[56] References Cited

U.S. PATENT DOCUMENTS

| | | | |
|---|---|---|---|
| 3,715,838 | 2/1973 | Young et al. | 451/87 |
| 4,064,661 | 12/1977 | Maeda | 451/87 |
| 4,563,840 | 1/1986 | Urakami | 451/87 |
| 5,210,996 | 5/1993 | Fassauer | 15/327.3 |
| 5,553,347 | 9/1996 | Inoue et al. | 15/327.3 |

FOREIGN PATENT DOCUMENTS

| | | | |
|---|---|---|---|
| 404319321 | 11/1992 | Japan | 15/327.3 |
| 1020123 | 5/1983 | U.S.S.R. | 15/327.3 |

*Primary Examiner*—Timothy V. Eley
*Assistant Examiner*—Derris H. Banks
*Attorney, Agent, or Firm*—Lane, Aitken & McCann

[57] ABSTRACT

A blast head has an air cushion device that directs a flow of relatively high velocity air inwardly and toward the surface being blasted from around the periphery of the blast head. This air flow creates a barrier preventing the escape of particles and debris from the blast head and also creates a so-called ground effect; i.e. the air flow between the head and the surface creates a force that lifts the head off the surface being blasted so that the head floats on cushion of air.

9 Claims, 5 Drawing Sheets

AIR CUSHIONED VACUUM BLAST HEAD

BACKGROUND OF THE INVENTION

The present invention relates to vacuum blasting machines, and more particularly, to an improved blast head for use in vacuum-blasting machines.

As will be appreciated by those skilled in the art, vacuum blasting refers to a technology for cleaning and preparing surfaces by blasting the surface with abrasive particles entrained in a relatively high velocity air stream and simultaneously vacuuming away abrasive particles and debris. Vacuum blasting machines use a vacuum blast head, with a small hood that surrounds a blasting nozzle, and a vacuum chamber within the hood, to suck up the abrasive particles and debris loosened from the surface being blasted. This abrasive particle and debris mixture passes through a hose to a separator, where the debris is separated from the abrasive particles. The separated debris is deposited in a waste chamber and abrasive particles, separated from the debris, may be returned to a hopper and used again in the blasting operation. Vacuum-blasting machines provide closed-system blasting by making the blast head in effect a small containment structure. In operation, the system is virtually dust free and, therefore, relatively safe for the operator and the environment, even when used to blast surfaces covered with potentially hazardous materials, such as lead and radioactive contaminants.

FIG. 1 shows a prior art blast head, indicated generally by the reference numeral 1, in position to clean a planar surface 4, such as, for example a bridge, building, ship, or aircraft member. The blast head 1 includes a blast jacket 5, a nozzle 6 feeding abrasive particles 7 entrained in a stream of compressed air directed through the blast jacket so that the particles traverse the narrow gap 4*a* separating the surface 4 and the open end of the blast jacket 5 and strike the surface 4. A vacuum jacket 8 surrounds the blast jacket, and a takeoff 9 in the vacuum jacket is connected to a vacuum source. The general trajectory of the particles 7 is indicated by the arrows 7*a*. A metal or plastic brush ring 8*a* is secured at a forward end of the vacuum jacket 8 for engaging a work surface and preventing the escape of abrasive particles 7. The "brush ring" does not directly prevent dispersal of abrasive and debris. Instead, it enables the economic maintenance of negative pressure, with respect to the ambient, in the blast area, and a vacuum air flow of sufficient velocity to transport the entrained particles. This ensures the recovery and prevents dispersal of abrasive and coating debris, and in particular, dust particles. The magnitude of the vacuum is greater than the magnitude of the pressure of the compressed air at the forward end of the blast head 1. As a result, there is a resultant vacuum which draws the blast head 1 into engagement with the work surface 4.

There are problems related to the brush ring 8*a*. One problem is a requirement that the operator keep the blast head constantly perpendicular to the blast surface; any gap between the brush ring and the blast surface would allow the abrasive (and dust) to escape to outside the constant structure. Another problem is damage to the blast surface due to friction (scratching) between the brush and the surface. In addition, the brush needs frequent replacement.

SUMMARY OF THE INVENTION

An object of this invention is the provision of a vacuum blast head with a particle and debris barrier which allows some off-axis motion of the head, which is not subject to wear, and which will not mar the surface being blasted.

Briefly, this invention contemplates the provision of a blast head with an air cushion device that directs a flow of relatively high velocity air inwardly and toward the surface being blasted from around the periphery of the blast head. This air flow creates a barrier preventing the escape of particles and debris from the blast head and also creates a so-called ground effect; i.e. the air flow between the head and the surface creates a force that lifts the head off the surface being blasted so that the head floats on cushion of air.

BRIEF DESCRIPTION OF THE DRAWINGS

The foregoing and other objects, aspects and advantages will be better understood from the following detailed description of a preferred embodiment of the invention with reference to the drawings, in which.

DESCRIPTION OF THE PREFERRED EMBODIMENTS

Figure 1:
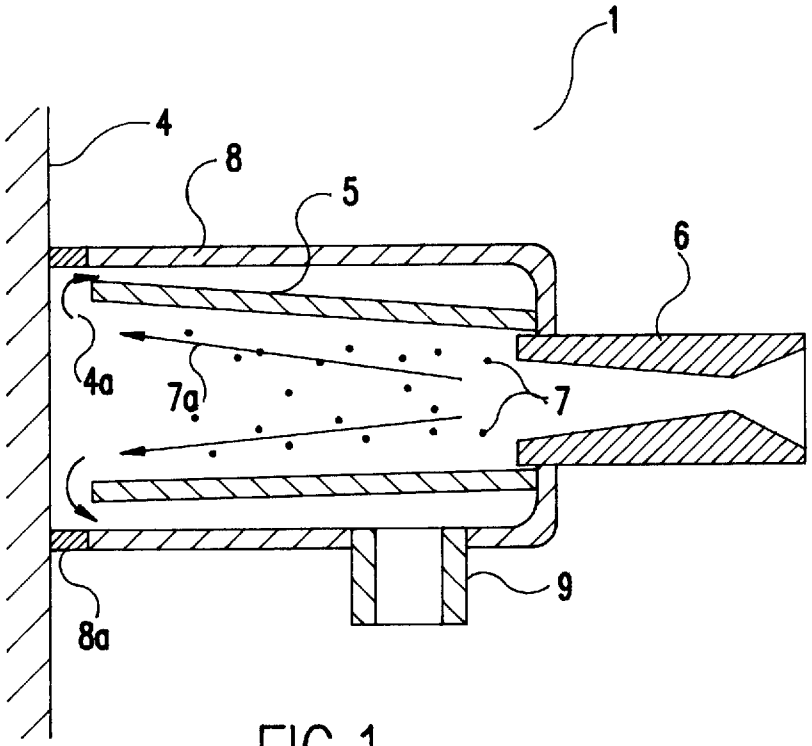
FIG. 1 PRIOR ART
FIG. 1 is a schematic, sectional drawing of a typical prior art blast head.
Figure 2:
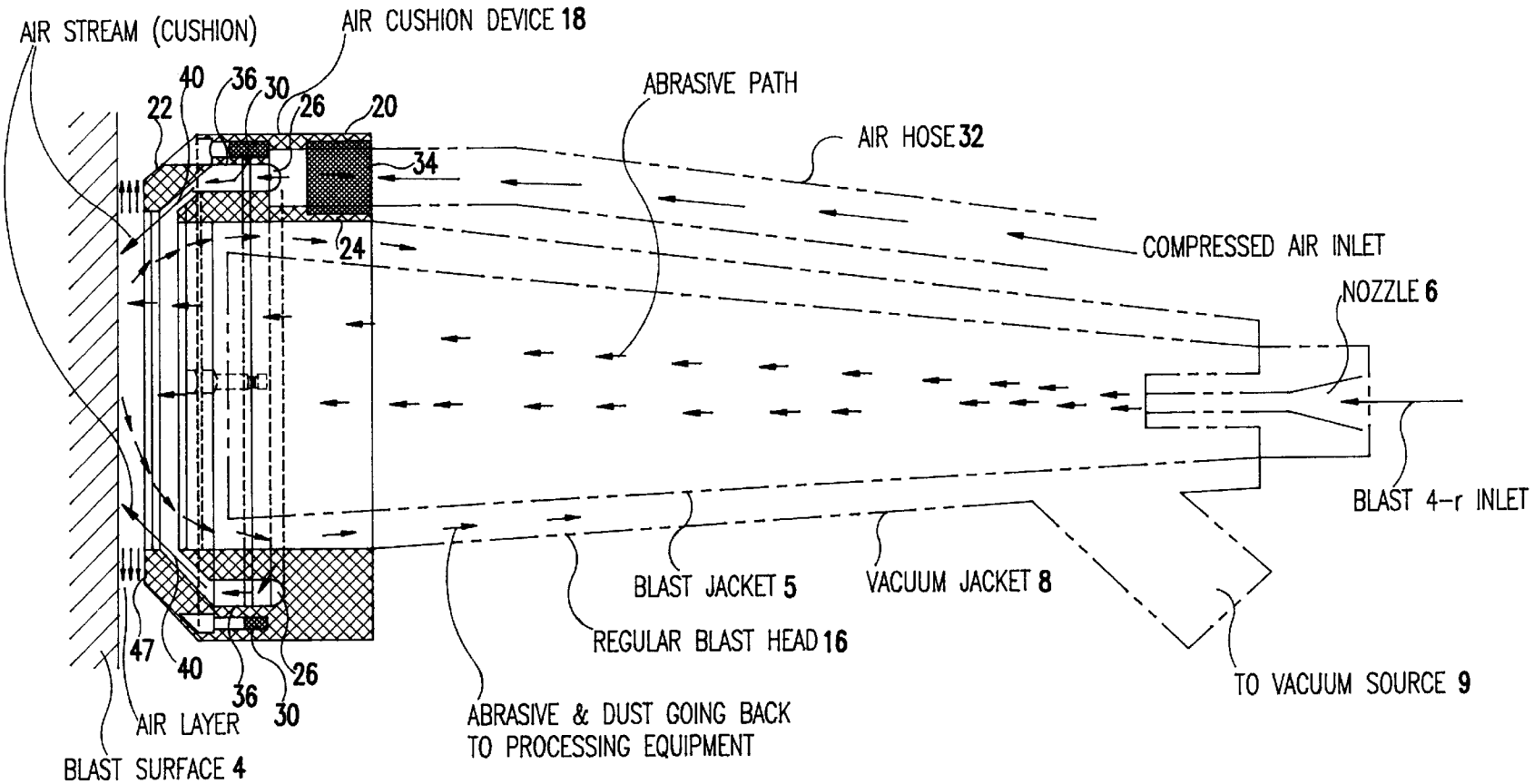
FIG. 2 is a schematic drawing of a blast head similar to the one shown in FIG. 1 equipped with one embodiment of an air cushion device in accordance with the teachings of this invention.
Figure 3:
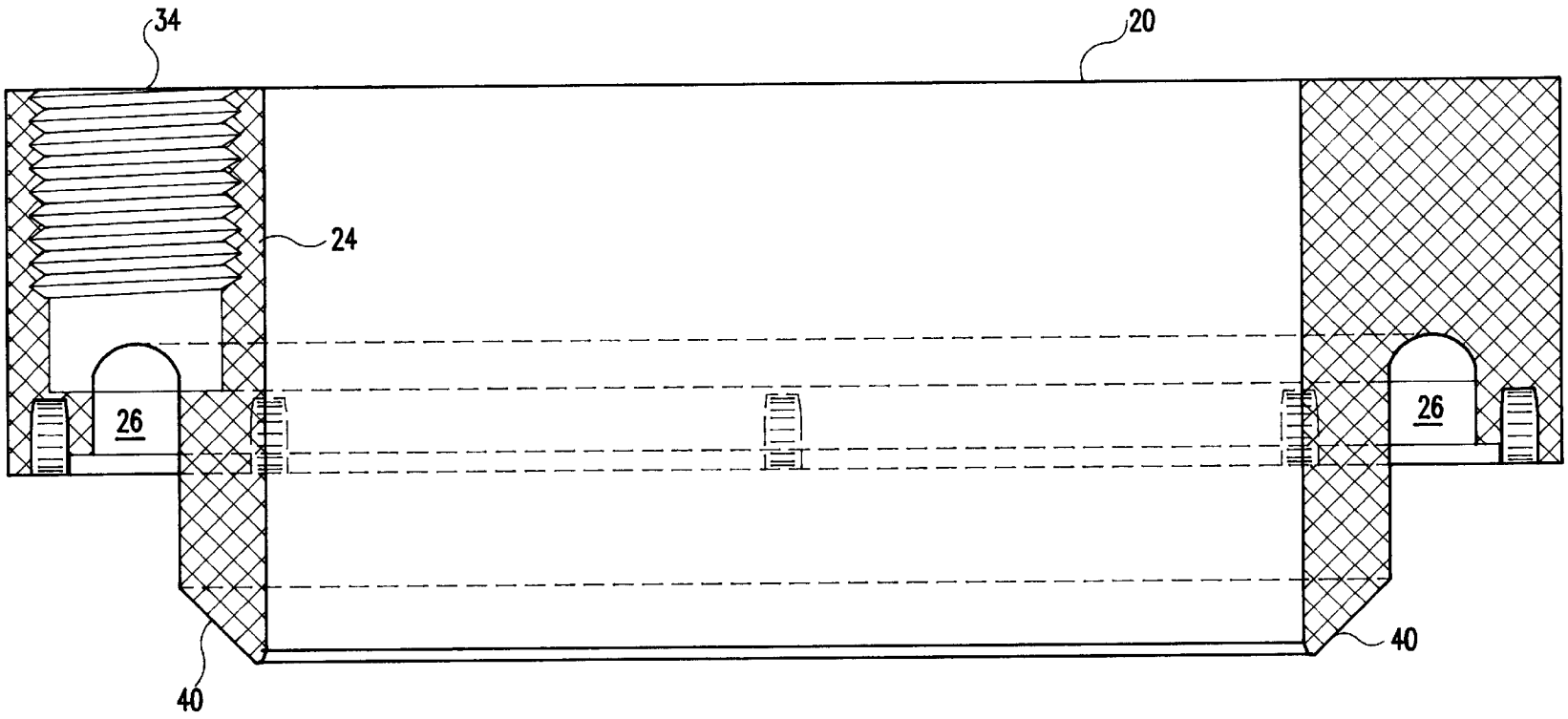
FIG. 3 is a cross-sectional view of the base of the air cushion device shown in FIG. 2.
Figure 4:
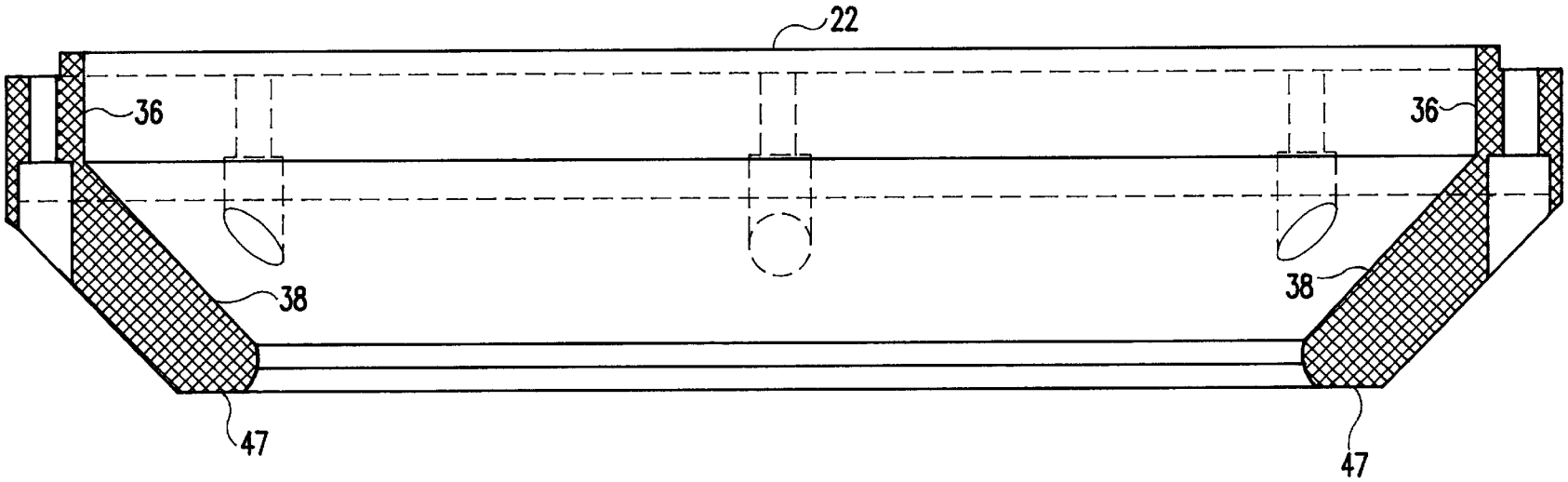
FIG. 4 is a cross-sectional view of the cap of the air cushion device shown in FIG. 2.

Referring now to FIGS. 2,3, and 4, in this specific embodiment of the invention, an air cushion device 18 for a blast head of the type generally illustrated in FIG. 1 is comprised of two members, a base 20 and a cap 22. Preferably, the blast head includes a pressure regulator 16 of the type disclosed in copending application Ser. No. 08/543,143 filed Oct. 13, 1995, assigned to the assignee of this application, and incorporated herein by reference.

As best shown in FIGS. 2 and 3, the base 20 is a generally cylindrical member, with an inner cylindrical surface 24 that fits over and engages the outer surface of the vacuum jacket 8. An annular groove 26 in the wall 28 of the base 20 forms (in combination with the cap 22) a chamber or plenum 30, which is filled with air under pressure from a pressure hose 32 screwed into an opening 34 in the top of the base.

Referring now also to FIG. 4, the cap 22 is generally dish shaped with an upstanding side wall 36 which forms the outer wall of the chamber 30. The cap 22 has inwardly sloping surface 38. When the base and the cap are assembled, sloping surface 38 faces a sloping surface 40 on the base and cooperates with an inwardly sloping surface 40 of the base 20 to form a nozzle 44 which extends around the circumference of the head and directs air into the space or gap between the end of the blast jacket 5 and the surface 4. Sufficient air is directed by the nozzle 44 into the gap to create a ground effect which lifts the head (i.e. the cap) off the surface with a cushion of air flowing outwardly between the lower surface 47 of the cap and the surface 4. At the same time, the inward direction of the air flow creates a barrier to the outward flow of blast particles and debris from the surface 4. Bolts (not shown) fit through openings 50 spaced around the cap 22 and are screwed into threaded bores in the base 20) to secure the cap to the base. The base 20 can be secured to the vacuum jacket in any of a number of suitable ways, such as, for example, epoxy, or welding. The air cushion nozzle can be made by other methods.

In operation, the nozzle 44 directs a stream of relatively fast moving air downwardly, toward the surface of the work piece, and inwardly, toward the particle stream (e.g. at an angle of about 45 degrees with respect to the longitudinal axis of the blast head). This creates an air barrier, which confines any stray particles or debris from the surface within the enclosure created by the vacuum jacket. The vacuum pressure, the particle stream pressure and barrier nozzle pressure are adjusted one relative to the other so that there is a positive pressure between the surface and the blast head creating sufficient pressure between the head and the surface to lift the head from the surface so air flows out between the peripheral surface 47 of the cap 22 and the surface 4, and the head rides on this air cushion.

Figure 5A:
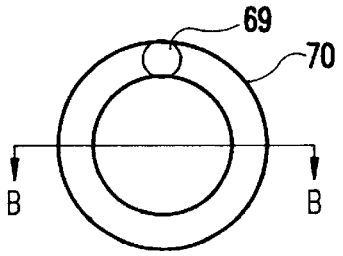
FIGS. 5A and 5B are, respectively, plan and sectional views of an alternate one piece nozzle for an air cushion device in accordance with the invention.
Figure 5B:
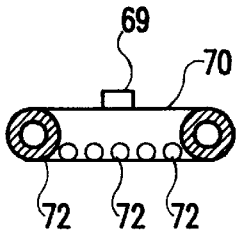
Figure 6A:
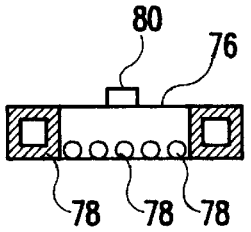
FIGS. 6A and 6B are, respectively, plan and sectional views of another alternate nozzle.
Figure 6B:
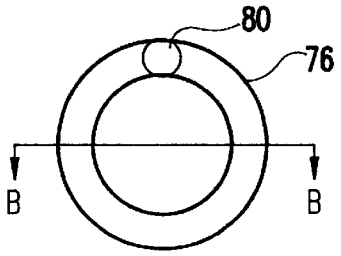

FIGS. 5 and 6 illustrate one piece designs for directing air into the gap between the blast head and the surface of the work piece in order to provide an air cushion for the blast head. In the design of FIG. 5, a circular tube 70 has a series of ports 72 to direct air into the gap and the air hose 32 connects to a fitting 69. The embodiment of FIG. 6 is similar to FIG. 5. Here, a one piece cast member 76 has a series of ports 78 to direct air into the gap. The air hose 32 connects to a fitting 80.

These and other modifications may be made to the specific embodiment of the invention without departing from. the spirit and scope of the invention.

We claim:

1. A blast head for a vacuum blaster, comprising in combination:

a blast jacket for directing a stream of particles toward a surface separated by a gap from an open end of said blast jacket;

a vacuum jacket around said blast jacket disposed to suck up particles from said stream of particles that traverse said gap and strike said surface; and means disposed around said open end of said blast jacket for directing air into said gap to create an air barrier between said blast head and said surface to direct said particles and debris from said surface area into said vacuum jacket and to create a ground effect pressure that lifts said blast heat from said surface.

2. A blast head for a vacuum blaster as in claim 1, wherein said means for directing air into said gap comprises a nozzle means which surrounds said open end of said blast jacket.

3. A blast head for a vacuum blaster as in claim 2, wherein said nozzle means directs said air into said gap at; an angle of approximately 45 degrees with respect to said surface.

4. A blast head for a vacuum blaster as in claim 3, wherein said nozzle means is comprised of a base secured to said head and a cap secured to said base.

5. A blast head for a vacuum blaster as in claim 3, wherein said nozzle means is comprised of a series of ports in an annular ring.

6. A blast head for a vacuum blaster as in claim 2, wherein said nozzle means is comprised of a base secured to said head and a cap secured to said base.

7. A blast head for a vacuum blaster as in claim 2, wherein said nozzle means is comprised of a series of ports in an annular ring.

8. A blast head for a vacuum blaster as in claim 1, wherein said means for directing air into said gap comprises a means which surrounds said open end of said blast jacket.

9. A blast head for a vacuum blaster as in claim 1, wherein said means for directing air into said gap directs said air into said gap at an angle of approximately 45 degrees with respect to said surface.

* * * * *